US006222316B1

(12) United States Patent
Park

(10) Patent No.: US 6,222,316 B1
(45) Date of Patent: Apr. 24, 2001

(54) BARRIER STRUCTURE OF PLASMA DISPLAY PANEL

(75) Inventor: Myung-Ho Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/098,543

(22) Filed: Jun. 17, 1998

(30) Foreign Application Priority Data

Jun. 19, 1997 (KR) ..... 97-25718

(51) Int. Cl.[7] ..... H01J 17/49

(52) U.S. Cl. ..... 313/582; 313/585; 313/491; 313/587

(58) Field of Search ..... 313/491, 492, 313/493, 582, 587, 585

(56) References Cited

U.S. PATENT DOCUMENTS 5,717,292 * 2/1998 Jin et al. ..... 313/582
5,834,896 * 11/1998 Hayashi et al. ..... 313/585
5,914,563 * 6/1999 Lee et al. ..... 313/585
5,952,782 * 9/1999 Nanto et al. ..... 313/584

* cited by examiner

*Primary Examiner*—Nimeshkumar D. Patel
*Assistant Examiner*—Karabi Guharay
(74) *Attorney, Agent, or Firm*—Finnegan, Henderson, Farabow, Garrett & Dunner, L.L.P.

(57) ABSTRACT

A barrier structure of a plasma display panel that can prevent an excessive increase of discharging current during a supply of discharging voltage and thereby avoid damages to electrodes caused by an excessive discharging current. A plasma display panel including both a first and second substrate, the second substrate spaced a distance from the first substrate. The plasma display panel also includes sustain electrodes arranged in parallel with one another on the first substrate; data electrodes arranged on the second substrate substantially perpendicular to the sustain electrodes; and a barrier on the first substrate and projected toward the second substrate, the barrier having at least one side contacting at least one sustain electrode.

10 Claims, 2 Drawing Sheets

BARRIER STRUCTURE OF PLASMA DISPLAY PANEL

BACKGROUND OF THE INVENTION

A. Field of the Invention

The present invention relates to a barrier structure of a plasma display panel and, particularly, to a barrier structure formed on a substrate in order to define a space for discharges.

B. Discussion of Related Art

A typical color PDP (Plasma Display Panel), as shown in FIG. 1, has upper and lower structures. The upper structure, which is viewed the side for better understanding, consists of upper substrate 1, dielectric layer 5 for sustaining surface charges formed during a discharge of the sustain electrodes 3, a protection layer 6, and upper barriers 9. The lower structure consists of lower substrate 2, lower electrodes 4 formed on the lower substrate 2 perpendicular to the sustain electrodes 3, lower barriers 7 formed between the upper and lower substrates 1 and 2 in parallel with the lower electrodes 4, and phosphor 8 coated on the surface of the lower barriers 7.

The space between the upper and lower structures is sealed with inert gas contained therein, forming a discharging area.

Initially, when a high voltage is applied sufficient to cause discharges in all discharging cells on the panel between both ends of the sustain electrodes 3, the charges formed on the surfaces of the barriers 7 and 9 and the dielectric layer 5 are eliminated and charges are thereby distributed uniformly all over the discharging cells. As a result, the inner surface of the discharging area has no charge formation.

In the subsequent addressing step, cells to be discharged are supplied with an address voltage, causing a discharge between the lower electrodes 4 and the sustain electrodes 3 that are energized by a scan voltage, thus forming wall charges on the surface of the protection layer 6.

A sustain voltage is then applied between the sustain electrodes 3 during a sustain period so as to sustain the discharges in the cells having wall charges. Discharges cannot continue in the cells that have no wall charges formed thereon, when sustain voltage is supplied.

However, as shown in FIG. 2, a discharging voltage applied to both ends of transparent electrode lines a and a' out of sustain electrodes 3 causes a cooperative surface discharge in the discharging area. Bus electrode lines b and b' are formed on the transparent electrode lines a and a', respectively, to prevent a voltage drop that may be caused by the resistance of the transparent electrode lines a and a'. Unfortunately, an excessive discharging current generated at this stage can damage the electrodes.

SUMMARY OF THE INVENTION

Accordingly, the present invention is directed to a barrier structure of a plasma display panel that substantially obviates one or more of the problems due to limitations and disadvantages of the related art.

An object of the present invention is to provide a barrier structure of a plasma display panel that prevents an excessive increase of discharging current during a supply of discharging voltage by forming a barrier between the bus electrodes of adjacent cells of the upper substrate and having both ends of the barrier being in contact with the bus electrodes.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

A plasma display panel in accordance with one embodiment of this invention includes a first substrate; a second substrate spaced a distance from the first substrate; a plurality of sustain electrodes arranged in parallel with one another on the first substrate; a plurality of data electrodes arranged on the second substrate substantially perpendicular to the sustain electrodes; and a barrier on the first substrate and projected toward the second substrate, the barrier having at least one side contacting at least one sustain electrode.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENTS

Reference will now be made in detail to the preferred embodiments of the present invention, examples of which are illustrated in the accompanying drawings.

Figure 1:
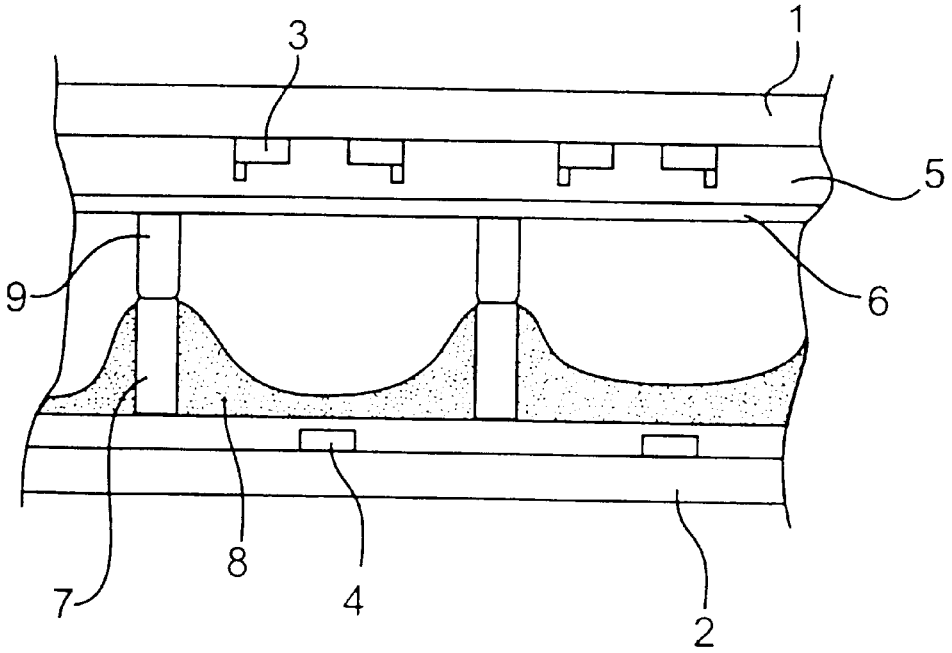
FIG. 1 PRIOR ART
FIG. 1 is a side view of the structure of a generic cell in a plasma display panel.
Figure 2:
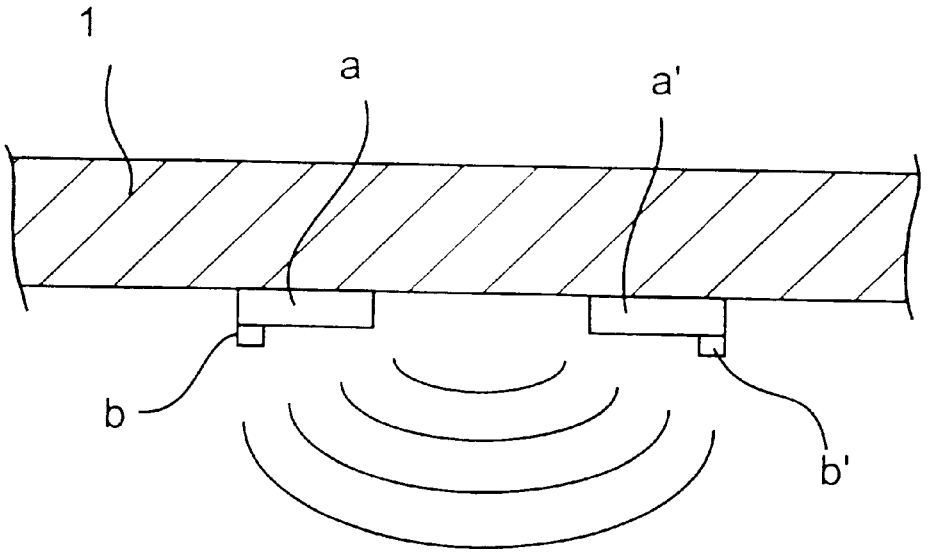
FIG. 2 PRIOR ART
FIG. 2 is a side view of the electrodes of the upper substrate in prior art.
Figure 3:
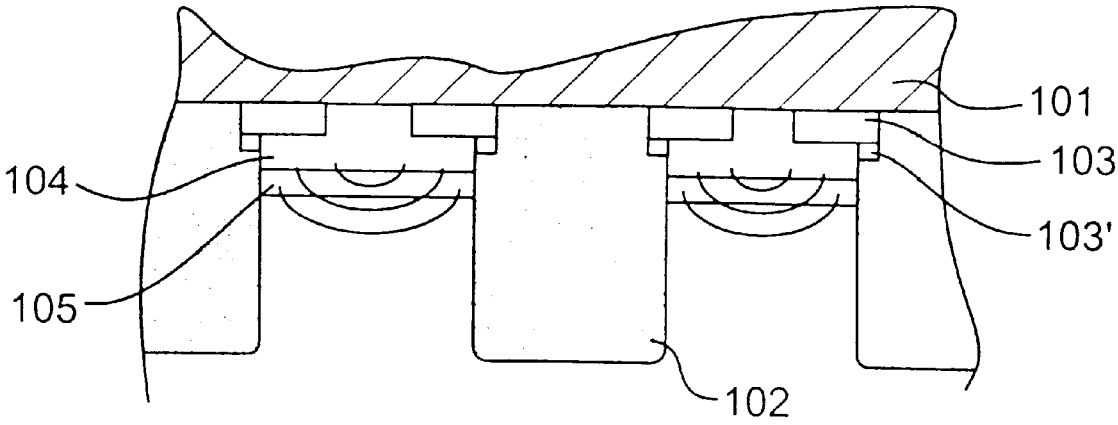
FIG. 3 illustrates the construction of the electrodes and barriers of the upper substrate according to the present invention.

FIG. 3 shows the construction of the electrodes and barriers of the upper substrate according to the present invention.

Referring to FIG. 3, upper substrate 101 has sustain electrodes arranged in parallel with one another, the sustain electrodes each including a pair of electrodes, i.e., transparent electrode 103 and bus electrode 103' which is formed on the transparent electrode 103. Between the pairs of sustain electrodes is formed a barrier in contact with the electrode surfaces.

Reference numerals 104 and 105 denote a dielectric layer and a protection layer, respectively.

A discharging voltage, if it is applied to both ends of the transparent electrode 103 in the upper substrate as constructed above, causes a cooperative surface discharge. Bus electrode 103' is formed on the transparent electrode line 103 to prevent the voltage drop caused by the resistance of the transparent electrode line 103.

As shown in FIG. 3, the barrier 102 can inhibit an excessive increase of discharging current since it is formed in contact with the bus electrode 103'.

Additionally, a light-shielding material is incorporated into the barrier material so that the barrier itself functions as a light-shielding layer. It is preferable that the light-shielding material is a nonconducting substance to prevent the electrical connection between the electrodes.

According to another preferred embodiment of the present invention, a light-shielding layer is interposed between the barrier and the upper substrate so as to enhance the contrast between cells.

As described above, the present invention can inhibit an increase of discharging current on the sustain electrodes and at the same time prevent the damage of the electrodes caused by an excessive discharging current, thereby enhancing the efficiency of the products.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A plasma display panel including a plurality of cells, comprising:

a first substrate;

a second substrate spaced a distance from the first substrate;

a plurality of pairs of sustain electrodes arranged in parallel with one another on the first substrate;

a plurality of data electrodes arranged on the second substrate substantially perpendicular to the sustain electrodes, wherein each cell is located at an intersection between a pair of sustain electrodes and a data electrode; and a plurality of barriers arranged in parallel with one another on the first substrate and projected toward the second substrate, a barrier having a first side contacting a first sustain electrode and a second side contacting a second sustain electrode.

2. The plasma display panel as in claim 1, wherein the barrier contacts a metal electrode line of the sustain electrode.

3. The plasma display panel as in claim 1, wherein the barrier includes a light-shielding material.

4. The plasma display panel as in claim 3, wherein light-shielding material includes a nonconducting substance.

5. The plasma display panel as in claim 1, further comprising a light-shielding material between the barrier and the first substrate.

6. The plasma display panel as in claim 5, wherein light-shielding material includes a nonconducting substance.

7. The plasma display panel as in claim 1, wherein the barrier contacts two adjacent sustain electrodes.

8. The plasma display panel of claim 1, wherein each sustain electrode is comprised of a transparent electrode and a metal electrode.

9. The plasma display panel of claim 8, wherein the metal electrode is formed on the transparent electrode.

10. The plasma display panel of claim 1, wherein a first sustain electrode and a second sustain electrode contacting a barrier are from different pairs of sustain electrodes.

* * * * *